United States Patent [19]

Schoenwald

[11] Patent Number: 4,907,945

[45] Date of Patent: Mar. 13, 1990

[54] SIDE-CHANNEL COMPRESSOR

[75] Inventor: Siegfried Schoenwald, Bad Neustadt/S, Fed. Rep. of Germany

[73] Assignee: Siemens Aktiengesellschaft, Munich, Fed. Rep. of Germany

[21] Appl. No.: 338,971

[22] Filed: Apr. 14, 1989

[30] Foreign Application Priority Data

May 30, 1988 [DE] Fed. Rep. of Germany ... 8807064[U]

[51] Int. Cl.[4] ..... F01D 5/08

[52] U.S. Cl. ..... 415/117; 415/55.1

[58] Field of Search ..... 415/55.1, 55.5, 116, 415/117, 175, 176, 177, 114, 115

[56] References Cited

U.S. PATENT DOCUMENTS

| | | | |
|---|---|---|---|
| 1,400,813 | 12/1921 | Graemiger | 415/116 |
| 2,786,626 | 3/1957 | Redcay | 415/116 |
| 3,233,551 | 2/1966 | Oshima | 415/116 |
| 3,436,916 | 4/1969 | Becker | 415/47 |
| 3,663,117 | 5/1972 | Warren | 415/116 |
| 4,363,598 | 12/1982 | Schonwald | 415/55.5 |
| 4,695,224 | 9/1987 | Lown | 415/116 |

FOREIGN PATENT DOCUMENTS

| | | | |
|---|---|---|---|
| 2138383 | 2/1973 | Fed. Rep. of Germany . | |
| 2166847 | 1/1976 | Fed. Rep. of Germany . | |
| 28731 | of 1911 | United Kingdom | 415/55.6 |
| 153603 | 12/1921 | United Kingdom . | |
| 1355727 | 6/1974 | United Kingdom . | |

*Primary Examiner*—Robert E. Garrett
*Assistant Examiner*—John T. Kwon
*Attorney, Agent, or Firm*—Kenyon & Kenyon

[57] ABSTRACT

A side-channel compressor includes a rotor having transport blades, and an injection nozzle for introducing a cooling liquid into a transport section of the compressor. Damage to the transport blades by droplets of liquid can be avoided by the providing the injection nozzle at the part of the compressor housing forming the side channel. The injection nozzle directs the coolant into a side channel space which is free of the transport blades.

12 Claims, 3 Drawing Sheets

SIDE-CHANNEL COMPRESSOR

BACKGROUND OF THE INVENTION

The present invention relates to a side-channel compressor. More particularly, the present invention is directed to a side-channel compressor having a rotor with transport blades and including a device for introducing a cooling liquid into the transport section of the compressor in such a manner as to reduce damage to the transport blades of the rotor.

RELATED ART

It is known that the temperature of a gas increases, creating heat, when the gas is compressed. It is known to counteract the generation of heat by introducing a coolant, e.g., water, into a compression space of the side channel compressor. Through evaporation of the coolant, there is a relatively intensive cooling of the gas. However, known cooling methods and apparatuses are prone to damaging the transport blades of the rotor due to drops of liquid coolant coming into contact with the baldes as the coolant is introduced to the side-channel compression space.

SUMMARY OF THE INVENTION

It is an object of the present invention to introduce, in a side-channel compressor of the type described at the outset, a coolant into the transport section of the compressor in such a manner that damage to the transport blades of the rotor, which might otherwise develop due to drops of liquid coolant, is largely avoided.

According to the present invention, the stated problem is solved by providing at least one injection nozzle that injects the cooling liquid and disposing the nozzle in a particular part of the compressor housing forming the side channel. The injection nozzle injects the coolant into a side-channel space which is a portion of the side channel which is free of the transport blades. By such an arrangement of the injection nozzle the cooling liquid is mixed with the gas already in this side channel space and, together with the gas, the coolant flows from the side channel space into the space between the individual transport blades and the mixture thereby strikes the surface of the transport blades at a very flat angle.

According to a first embodiment of the present invention, a more intensive mixing and evaporation, which is made to occur as far as possible before the mixture of gas and coolant enter the space between the transport blades, can be achieved by providing that the injection nozzle is aligned in such a manner that it is inclined against the transport direction of the side channel compressor. The cooling liquid is thereby introduced against the flow direction of the gas, and, as a result, a strong turbulence is produced.

According to a second embodiment, turbulence which is not as strong as in the first embodiment, but which still provides a good mixing of the cooling liquid and the gas, can be obtained by providing that the injection nozzle is aligned in such a manner that it is inclined in the transport direction of the side-channel compressor so that its injection direction coincides, as greatly as possible, with the flow direction of the gas which is transported by the side-channel compressor and which is predominantly prevailing at the place of installation of the injection nozzle. Because of this coincidence of direction, a less pronounced turbulence is produced which in turn influences the output of the side-channel compressor less adversely.

A reduction of the intake volume of the side-channel compressor can be avoided by providing that the injection nozzle or nozzles are arranged approximately in the middle of a circumference between an inlet opening and an outlet opening of a housing of the compressor. With such an arrangement, the introduction of the cooling liquid occurs at a point farther removed from the inlet opening than in known side-channel compressors. As a result, there are no adverse reactions on the intake behavior of the side-channel compressor. This can further be explained by the fact that the cooling of the gas caused by the injection of the coolant results in a reduction of the pressure in the compressor, the result being a reduction in the volume of the gas. Any additional volume required for the injected coolant is largely compensated for by the reduction in volume of the gas. As a result, there is no substantial pressure change in the injection region which would influence the intake behavior of the side-channel compressor.

According to yet another embodiment the side channel compressor may include a multistage compressor set. In such a case it is advantageous to arrange the injection nozzle or nozzles at the housing of the stage or stages of the compressor that follow an input compressor stage than in the input compressor stage. In the multistage compressor set a higher temperature level prevails in the subsequent compressor stage. When cooling occurs in the following stages of the compressor set, it has a particularly intensive effect.

DETAILED DESCRIPTION

Figure 1:
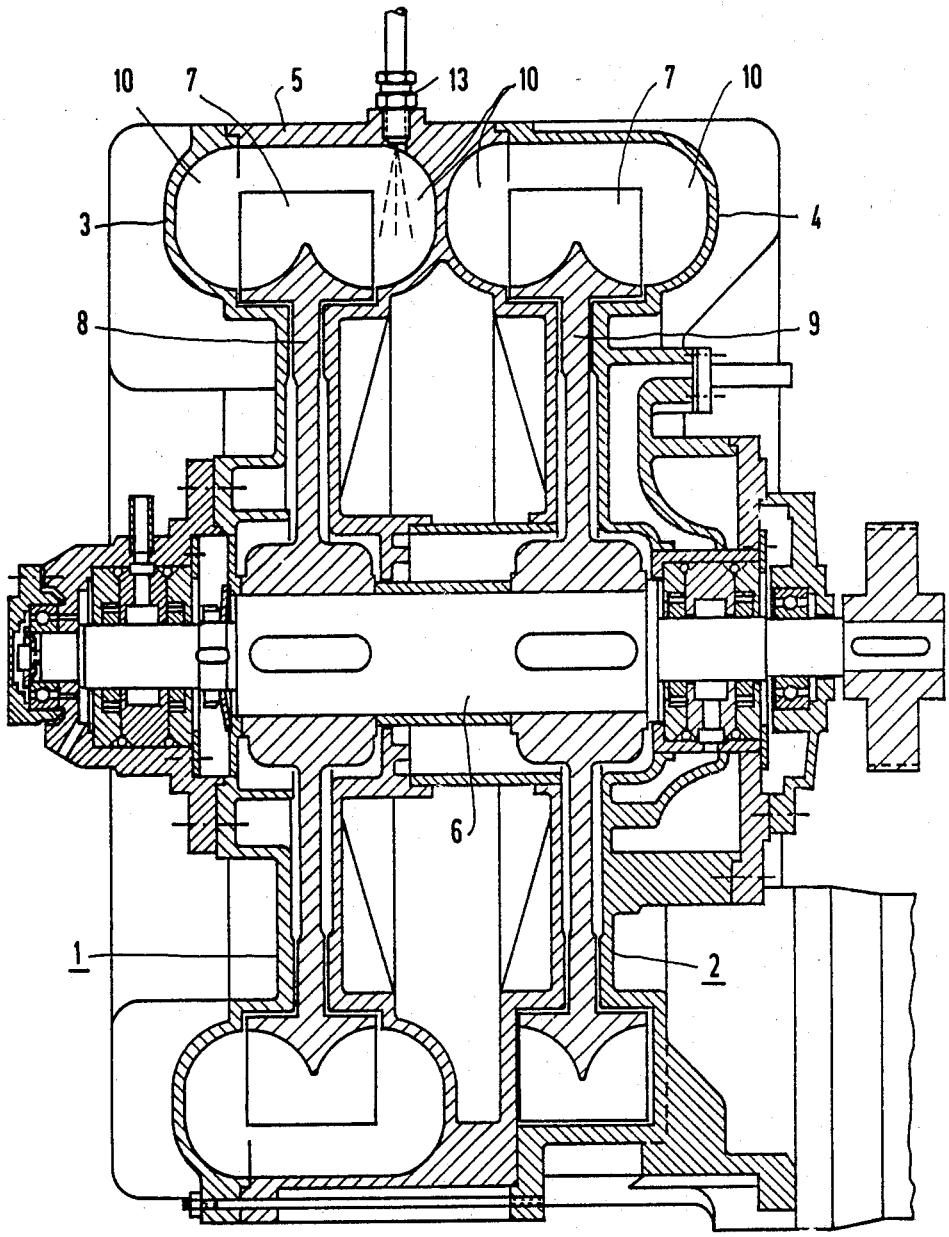
FIG. 1 shows a side-channel compressor consisting of two compressor stages, in a longitudinal section.

In FIG. 1 two side-channel compressors 1 and 2 respectively are assembled to form a multistage compressor set. The compressors each include outer housing parts 3 and 4 respectively. These outer housing parts are supplemented by an intermediate housing part 5 to form complete compressor housing in which are located rotors 8 and 9 that are located which are arranged on a common rotatably supported shaft 6 and are provided with transport blades 7. A side channel 10 is formed, laterally adjacent to a transport blade in each compressor, by suitably hollowing out the housing parts 3, 4 and 5.

Figure 2:
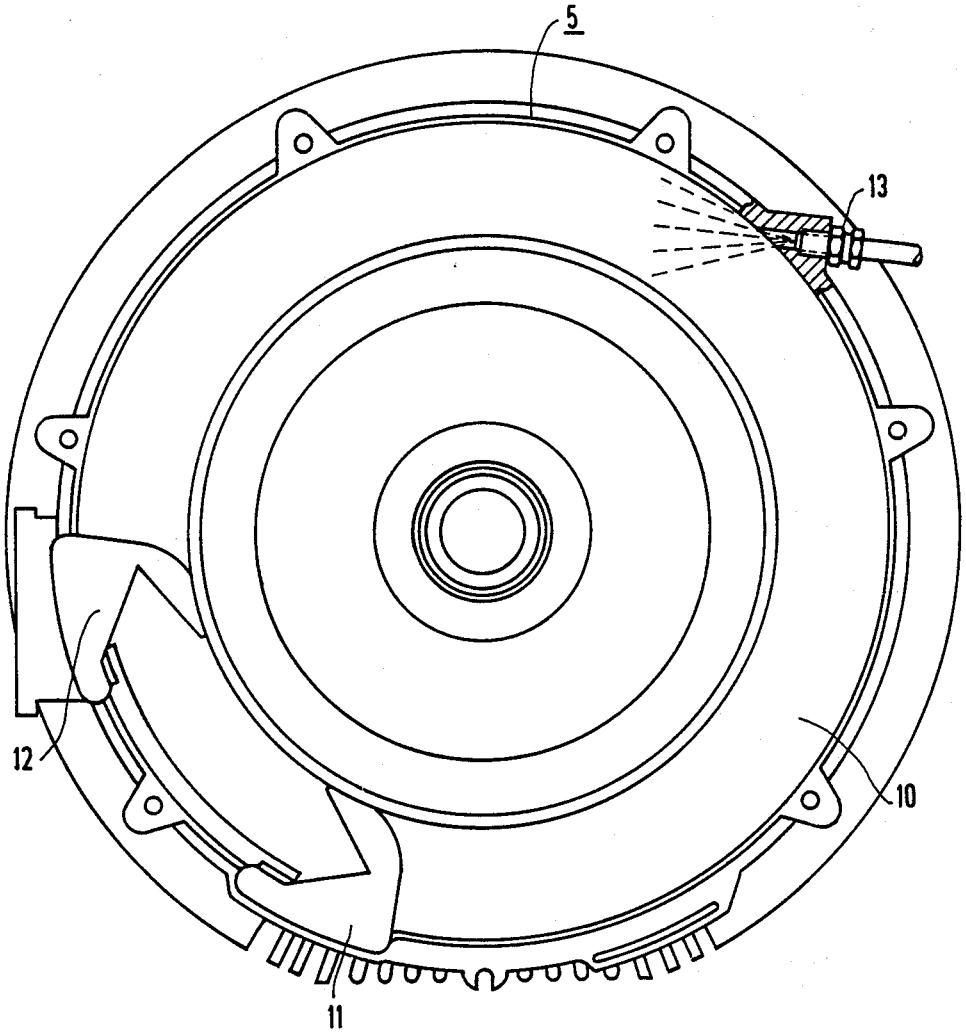
FIG. 2, illustrates a top view of a housing part of the side channel-compressor provided with an injection nozzle.
Figure 3:
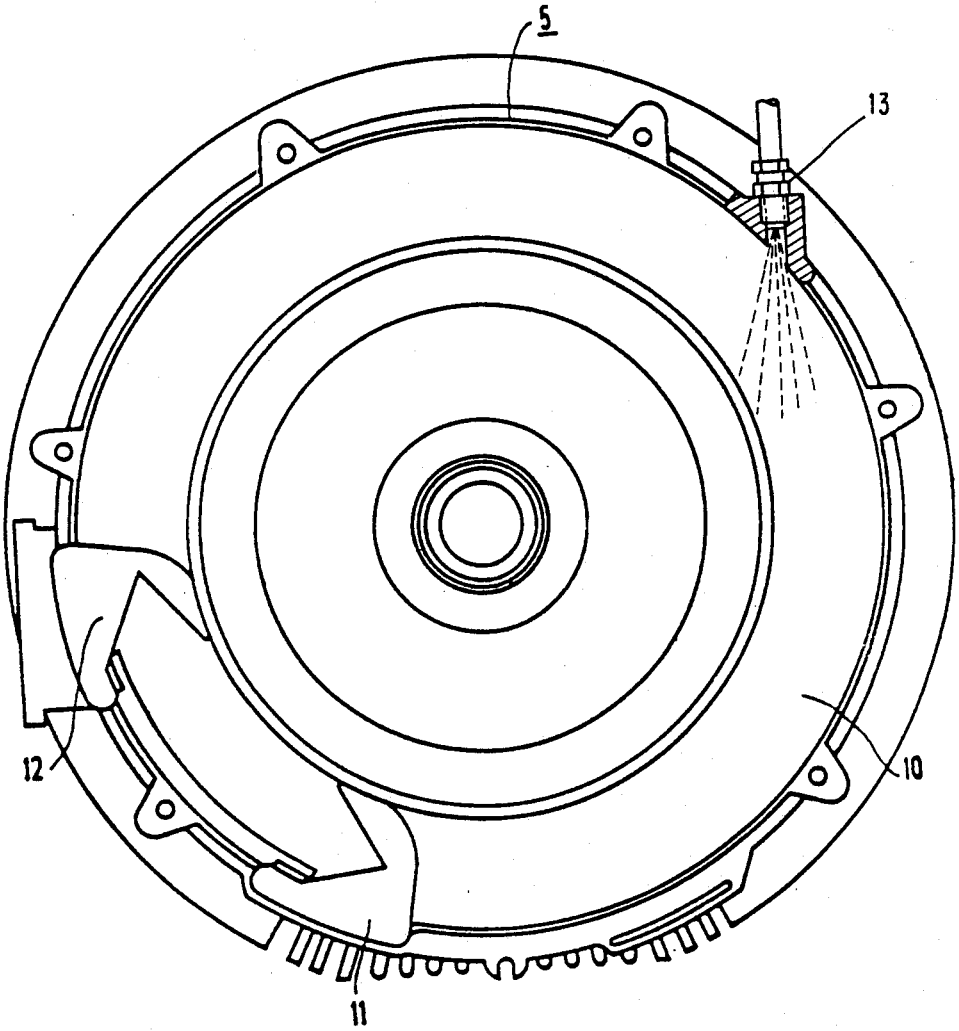
FIG. 3 illustrates a top view of a housing part of a side channel-compressor provided with an injection nozzle according to a second embodiment of the present invention.

As illustrated in FIG. 2, at the intermediate housing part 5, an injection nozzle 13 is arranged approximately in the middle of a circumference between an inlet opening 11 and an outlet opening 12 of the intermediate housing part 5. Through this injection nozzle 13, for instance, water can be injected into the side channel 10 into a side-channel space which is free of the transport blades. The water evaporates and the gas to be cooled is transported through the evaporated coolant by the side-channel compressor to cool the gas. The injection nozzle 13 is arranged at the intermediate housing part 5 to be inclined in such a manner that its injection direction coincides as far as possible with the flow direction of the transported gas at the point of installation of the injection nozzle 13.

By this arrangement of the injection nozzle, a disturbance of the gas flow through the formation of turbulence is largely avoided. However, there is sufficient interaction of the flow of the transported gas and the injected coolant to mix the two together. In addition, mixing the cooling liquid with the gas and also already partial evaporation of the cooling liquid occur already in the side channel 10. The mixture of gas and cooling liquid then enters from the side into the spaces between the transport blades 7 so that a hard impact of the cooling liquid particles leading to cavitation damage on the transport blades 7 is largely precluded.

According to a second embodiment, the injection nozzle can be aligned in such a manner that coolant is injected into the side-channel space in a direction opposite to the flow of the transport gas through the compressor. The result is the creation of a turbulence between the flow of the transported gas and the coolant which intensely mixes the two.

Furthermore, in such a multistage set compressor it is well known that the temperature of the transport gas in the input stage is lower than in the subsequent stages. To obtain a more intensive cooling effect it is possible to dispose the injection nozzle in such a manner as to introduce coolant into one of the later stages of the multistage set.

What I claim is:

1. A side-channel compressor comprising:

(a) a housing;

(b) a rotor, disposed in said housing;

(c) transport blades included on said rotor, said housing having a side-channel space free of said transport blades;

(d) an injection nozzle introducing a cooling liquid into the transport section of the compressor, wherein said injection nozzle is disposed on a portion of said housing and wherein the injection nozzle directs a coolant into said side channel space.

2. A side-channel compressor according to claim 1, wherein said injection nozzle is aligned in such a manner that it is inclined to introduce coolant in a direction against a direction of flow of a transport gas through the side-channel compressor.

3. A side-channel compressor according to claim 2, further comprising an inlet opening and an outlet opening wherein said injection nozzle is disposed in the compressor housing at approximately a point which is a circumferential middle point between said inlet opening and said outlet opening of the side channel compressor.

4. A side-channel compressor according to claim 3, wherein said compressor includes a plurality of compression stages, including an input compressor stage and wherein said injection nozzle is disposed in the housing of one of the plurality of compressor stages, said one stage follows said input compressor stage.

5. A side-channel compressor according to claim 2, wherein said compressor includes a plurality of compression stages, including an input compressor stage and wherein said injection nozzle is disposed in the housing of one of the plurality of compressor stages, said one stage follows said input compressor stage.

6. A side-channel compressor according to claim 1, wherein said injection nozzle is aligned in such a manner that it is inclined to introduce coolant in a direction coincident with a direction of flow of a transport gas through the side channel that prevails at the point the injection nozzle introduces the coolant.

7. A side-channel compressor according to claim 6, further comprising an inlet opening and an outlet opening wherein said injection nozzle is disposed in the compressor housing at approximately a point which is a circumferential middle point between said inlet opening and said outlet opening of the side channel compressor.

8. A side-channel compressor according to claim 7, wherein said compressor includes a plurality of compression stages, including an input compressor stage and wherein said injection nozzle is disposed in the housing of one of the plurality of compressor stages, said one stage follows said input compressor stage.

9. A side-channel compressor according to claim 6, wherein said compressor includes a plurality of compression stages, including an input compressor stage and wherein said injection nozzle is disposed in the housing of one of the plurality of compressor stages, said one stage follows said input compressor stage.

10. A side-channel compressor according to claim 1, further comprising an inlet opening and an outlet opening wherein said injection nozzle is disposed in the compressor housing at approximately a point which is a circumferential middle point between said inlet opening and said outlet opening of the side channel compressor.

11. A side-channel compressor according to claim 10, wherein said compressor includes a plurality of compression stages, including an input compressor stage and wherein said injection nozzle is disposed in the housing of one of the plurality of compressor stages, said one stage follows said input compressor stage.

12. A side-channel compressor according to claim 1, wherein said compressor includes a plurality of compression stages, including an input compressor stage and wherein said injection nozzle is disposed in the housing of one of the plurality of compressor stages, said one stage follows said input compressor stage.

* * * * *